United States Patent [19]

Lindquist et al.

[11] Patent Number: 4,584,017

[45] Date of Patent: Apr. 22, 1986

[54] METHOD FOR PRODUCING METALLIC LEAD BY DIRECT LEAD-SMELTING

[75] Inventors: Björn K. V. Lindquist; Stig A. Petersson, both of Skelleftehamn, Sweden

[73] Assignee: Boliden Aktiebolag, Stockholm, Sweden

[21] Appl. No.: 696,096

[22] Filed: Jan. 29, 1985

[30] Foreign Application Priority Data

Feb. 7, 1984 [SE] Sweden ..... 8400624

[51] Int. Cl.[4] ..... C22B 13/00

[52] U.S. Cl. ..... 75/77

[58] Field of Search ..... 75/77

[56] References Cited

U.S. PATENT DOCUMENTS

| | | | |
|---|---|---|---|
| 1,804,054 | 5/1931 | Hayward . | |
| 2,926,081 | 2/1960 | Schwartz . | |
| 3,689,253 | 9/1972 | Dorenfeld et al. | 75/77 |
| 4,008,075 | 2/1977 | Petersson . | |
| 4,017,308 | 4/1977 | Peterson . | |
| 4,080,197 | 3/1978 | Meissner et al. | 75/77 |
| 4,135,912 | 1/1979 | Matthew et al. | 75/77 |

FOREIGN PATENT DOCUMENTS 757946 9/1956 United Kingdom .

*Primary Examiner*—Melvyn J. Andrews
*Attorney, Agent, or Firm*—Burns, Doane, Swecker & Mathis

[57] ABSTRACT

The invention relates to a method for producing metallic lead from lead-containing starting materials by an oxidizing smelting process and subsequent reduction of the resultant oxidic molten bath. The reduction is effected with solid carbonaceous reduction agent present in the melt, and it is ensured that solid carbonate-containing material, preferably limestone, dolomite or soda ash, is also present in the melt, together with the reduction agent.

The method can be applied for working-up lead-starting materials of sulphidic, oxidic or sulphatic kind. In addition, the method can be applied to advantage for working-up lead-carbonate containing starting materials, where at least a part of the carbonate-containing material may comprise lead-starting material.

24 Claims, No Drawings

METHOD FOR PRODUCING METALLIC LEAD BY DIRECT LEAD-SMELTING

The present invention relates to a method for producing metallic lead from lead-bearing starting materials, by smelting the starting materials under oxidizing conditions and reducing the resultant oxidic melt. The invention relates to the working-up of all kinds of lead-bearing starting materials from which lead can be produced in this manner. Thus, such starting materials include sulphidic, sulphatic and oxidic lead starting materials, together with mixtures thereof. The lead starting materials may comprise mineral concentrates, intermediate products and waste products.

A number of the lead-smelting processes proposed in recent years comprise, in principle, an oxidizing smelting stage and subsequent reduction of the resultant molten oxidic bath. Thus, these processes which belong to the so-called direct lead-smelting processes and which result in the formation of a molten lead bath of low sulpher content and a slag of high lead content can all be said to belong to the said group of smelting processes. The Outokumpu process (c.f. for example DE-C-No. 1179004), the Cominco process (U.S. Pat. No. 3,847,595), the St. Joseph Lead process (J. Metals, 20 (12), 26–30, 1969), the Worcra process (U.S. Pat. No. 3,326,671), the Kivcet process (U.S. Pat. No. 3,555, 164), and the Q-S-process (U.S. Pat. No. 3,941,587), all belong to this group.

Other lead-smelting processes which include a smelt reduction are described in Bolident's earlier patent specifications U.S. Pat. No. 4,017,308 and U.S. Pat. No. 4,008,075, which relate ato processes for producing metallic lead from oxidic and/or sulphatic or sulphidic materials with the use of a top-blown rotary converter as the smelting and reduction unit. Similar processes are described in Boliden's earlier publications EP-A-Pat. No. 0 007 890 and EP-A-Pat. No. 0 006 832, which relate to processes in which metallic lead is produced from lead-containing intermediate products, and especially those which have a high copper and/or arsenic content.

A common feature of these earlier Boliden processes is that lead is produced in two stages. In the first of these stages, lead starting materials and fluxes are smelted with the aid of an oxygen-fuel flame which is passed over the surface of the material in the furnace, to form a molten lead phase poor in sulphur and a slag rich in lead oxide, the lead oxide content of the slag reaching from 20–50%. In the second stage of the process, coke or some other suitable reductant is added to the molten bath and the contents thereof reduced, while heating the bath and rotating the converter.

In a later Boliden patent application, SE-A-Pat. No. 8302468-9, (which corresponds to EP-A-Pat. No. 0 124 497), there is described a single stage process in which a reducing agent is charged to the converter together with the lead starting materials. This process is to be considered as one in which the oxidizing smelting of the starting materials and the reduction of the resultant melt are effected simultaneously, and this method is thus also included in the definition of lead-smelting processes encompassed by the invention.

A common feature of all lead-smelting processes based on the direct lead-smelting technique, that comprise a stage in which a melt comprising mainly lead oxide is subjected to a reduction process, is that the reduction rate is low and that a considerable length of time is taken to complete the reduction phase, thereby restricting the economy of the reduction stage. This also results in a high consumption of reducing agent, when seen against the unit weight of lead obtained; in other words the efficiency of the reducing agent, for example the coke efficiency, is low.

When working-up lead containing, oxidic-sulphatic intermediate products by direct lead-smelting processes, the consumption or reduction agent is reported to be between 150 and 200 kg of coke per ton of lead produced. For example, the amount of coke consumed in the Boliden Lead Kaldo Process, which is one of the most favourable processes in the present context, is roughly 70 kg for each ton ingoing lead, which corresponds to 150–160 kg for each ton of lead produced. The amount of coke consumed is not, in the main, dependent on whether or not the reduction time can be reduced. On the other hand, a shorter reduction time is more favorable from the aspet of the amount of energy consumed in maintaining a hot melt, when reduction is effected while heating the melt.

The amount of reducing agent consumed when working-up sulphidic material depends upon the amount of slag formed and its lead content, or the amount of sulphur present in the lead obtained. As mentioned in the aforegoing, the majority of so-called direct lead-smelting processes, the purpose of which is to smelt lead-containing starting materials to a molten lead bath of such low sulphur content that the lead can be treated by conventional lead refining methods, produce slags which prior to the reduction stage contain between 35 and 50% lead. In these processes, the coke consumption is normallly about 100 kg per ton lead produced.

It has now surprisingly been found that in lead-smelting processes of the aforesaid kind, the reduction stage can be made substantially more effective by means of a process according to the invention, which enables the reduction rate to be raised and the carbon efficiency (or similar efficiency) to be increased. In this way, the process economy of lead processes incorporating a melt-reduction stage can be greatly improved. To this end, the method according to the invention is characterized by the process stages set forth in the accompanying claims.

Thus, when practising the method according to the invention, reduction efficiency is greatly increased when reducing metallic lead from the melt obtained by the oxidizing smelting process. This is achieved by using in the reduction phase a solid carbonaceous reduction agent in the presence in the melt of a solid carbonate-containing material.

The solid carbonaceous reduction agent is preferably coke or coal.

The carbonate-containing materaial is preferably limestone, dolomite or soda ash. In the majority of cases the choice of material is determined by its retail price. The lump size of the carbonate-containing material is preferably of such coarseness the decomposition of the carbonate to oxide takes place as slowly as possible. In those tests carried out hitherto, limestone having a particle size of between 2–5 mm has been found much more effective than particle sizes beneath 2 mm.

The quantities in which carbonate-containing material is used are not critical. A quantity corresponding to approximatly half the amount of coke intended for the reduction stage has been found particularly suitable, however. Naturally, smaller quantites have also been found useful in certain contexts, for example when smaller quantities of slag are formed or when the slag formed has a low lead content. Consequently, it is not possible to place a lower limit on the amount of carbonate used. The upper limit of the carbonate additions is solely dependent upon the desired economy. Thus, the metallurgist is able to find in each particular case an optimum carbonate addition with respect to a decrease in the consumption of reduction agent, the decrease in reduction time and with respect to knowledge of the costs of reduction agent and carbonate material. From a purely technical viewpoint, there is no upper limit with respect to the amount of carbonate charged, other than those problems associated with the possible effect of the carbonate on the amut of slag formed and its composition. In the majority of cases, however, basic material, such as lime, magnesium oxide or soda ash, are charged to the lead-smelting process as slag formers or as fluxing agents. Thus, in the majority of cases, the addition of slag former or fluxing agents supplied to the slag through the oxide products resulting from decomposition of the carbonate-containing material is desirable, and can replace or supplement the normal addition of such slag formers or fluxing agents.

The carbonate-containing material charged to the converter, may comprise wholly or partially the lead-bearing starting materials. In other words, the lead-bearing starting materials may be comprised wholly or partially of carbonate-containing material. It has namely been found that minerals containing lead carbonate can be advantageously worked-up by means of the method according to the invention. For example, such minerals can be smelted and reduced with carbon in accordance with the method, the carbonate content of the mineral promoting the melt-reduction. Material containing lead-carbonate can also be mixed with other kinds of lead starting materials, and in such cases the process is supplied with the requisite carbonate addition and a certain percentage of produced lead.

The solid reduction agent and the carbonate-containing material are suitably introduced directly into the molten bath formed, during and/or after the oxidizing smelting process. In this respect, it is essential that both additions are introduced into the molten bath at such a stage in the process cycle and with the use of such technique that the additions can be taken up by and distributed throughout the bath in a relatively unaffected manner, or in other words be readily dispersed in the melt. Thus, in the case of two-stage processes, the solid materials are introduced into the molten phase or bath in a suitable manner upon completion of the smelting period, and are dispersed in said molten bath by mixing the same with the aid of mechanical or pneumatic means or some other suitable means. For example, the solid material can be injected into the bath through lances, tuyeres or nozzles. In a Kaldo converter, the solid materials can be injected against a curtain of falling droplets of the melt, obtained by rotating the converter in an inclined position, whereupn the solid materials are rapidly wetted and dispersed in the melt. Rotation of the converter also assists in enabling the solid materials to be held dispersed in the melt for as long as possible, which in turn favourably affects the efficiency of the reduction agent.

The majority of metal carbonate, alkali carbonate and alkali earth carbonate decompose rapidly at prevailing smelting temperatures, 1100°-1400° C., by so-called calcination in accordance with the reaction $$MCO_3 \rightarrow MO + CO_2$$

One important exception, however, is barium carbonate ($BaCO_3$) which has a decomposition pressure of solely 0.01 at at 1100° C. Thus, when the carbonate is heated while dispersed in the molten bath carbon dioxide is given-off as the carbonate decomposes. Part of the carbon dioxide thus generated will react with solid carbon from the reduction agent to form carbon monoxide in accordance with the following reaction formula:

$$C + CO_2 \rightleftharpoons 2CO$$

The carbon monoxide thus generated will contribute towards a more rapid reduction, partly by enhancing the agitation effect in the molten bath and partly by the generation of carbon monoxide directly in the bath and because the more rapid gas-solid-reaction $$PbO + CO \rightleftharpoons Pb + CO_2$$

will take place together with the solid-solid-reaction $$PbO + C \rightleftharpoons Pb + CO$$

In order to achieve intimate contact between reduction agent and carbonate material in the molten bath, the reduction agent and carbonate material can be mixed together before being introduced into said bath, for example in conjunction with crushing the reduction agent.

The invention will now be described in more detail with reference to a number of working embodiments thereof, in which the method according to the invention is also compared with methods and processes belonging to the prior art.

EXAMPLE 1

(a) 48.2 tons of lead-sulphide concentrate of the following main analysis; 47% Pb, 11.8% Fe, 7.2% Zn, 22.4% S and 3.3% $SiO_2$, were injected through a lance into a top-blown rotary converter of the Kaldo type having an inner diameter of 2.5 m together with 3.8 tons of silica, where the input material was continuously flash-smelted with 10800 $Nm^3$ oxygen and 12490 $Nm^3$ air. The flash-smelting process was continued for a total time of 220 minutes, whereafter 0.8 tons of coke were charged to the molten bath and the contents of the bath reduced for a time period of 100 minutes. During this reduction period, the molten bath was maintained at a temperature of about 1300° C. with the aid of an oil-oxygen burner, the amount of oil consumed being 514 liters. Approximately 12 tons of molten lead containing 0.20% sulphur was subsequently removed from the converter, together with a slag containing 4.7% lead. Thus, approximately 67 kg coke were consumed for each ton of lead produced.

(b) During another smelting cycle, the same quantity of a similar lead concentrate was flash-smelted in the converter together with a similar silica addition. In this case, the oxygen consumption was 10730 $Nm^3$ and the air consumption 10990 $Nm^3$. The flash-smelting process was continued for a period of 205 minutes whereafter 0.8 tons of coke and 0.3 tons of limestone having a particle size of 2-5 mm were charged to the converter. It was now possible to decrease the reduction period to 65 minutes, the oil consumption during this reduction being 468 liters. 14 tons of molten lead and a slag containing 4.2% lead were obtained and removed from the converter. Thus, the lead content of the slag was even lower than that of the slag obtained in the aforegoing smelting cycle. The coke consumption also dropped to about 50 kg per ton of lead produced.

These comparison runs illustrate that a carbonate addition, in this case, limestone, during the reduction phase substantially lowers the requisite reduction time and decreases the coke consumption.

EXAMPLE 2

30.6 tons of lead concentrate taken from the same batch as that in Example 1, together with a mix of 19.0 tons of lead-containing oxidic-sulphatic dust containing about 62% lead, and 2.4 tons of silica, were flash-smelted in a rotary converter of the kind described in Example 1. The flash-smelting period had a duration of 150 minutes, during which 9180 $Nm^3$ of oxygen and 6960 $Nm^3$ of air were consumed. Upon completion of the smelting period, 0.5 tons of coke and 0.3 tons of limestone having the same particle size as that recited in Example 1b were charged to the converter. After reducing the bath for 50 minutes, the lead content of the slag had fallen to 3.1%. 336 liters of oil were used during the reduction period for maintaing the temperature of the molten beth. Approximately 19 tons of molten lead, having a sulphur content of 0.33%, were removed from the converter together with a slag containing 3.1% lead. In this case, only about 25 kg of coke were consumed during the reduction process for each tone of lead produced.

EXAMPLE 61.6 tons of a sulphidic, carbonate-containing lead concentrate of the following main analysis: 53.1% Pb, 6.7% Zn, 19.4% S (of which 12.0% is sulphide sulphur), 7.9% Fe, 3.0% $SiO_2+Al_2O_3$ and 1.36% C (present as carbonate) were flash-smelted with 2500 $Nm^3$ oxygen. During the smelting period, which had a duration of 165 minutes, 4 tons of silica and 11 tons of limestone were charged as fluxes to the converter. Upon completion of the smelting process, 1.1 tons of coke were charged to the converter, for the purpose of reducing the molten bath therein, the temperature of the bath being maintained by heating with an oil-oxygen gas burner. The reduction period had a duratin of 120 minutes, during which 634 liters of oil were consumed. 27 tons of slag containing 1.0% lead and 18.5 tons of 99.5% lead were removed from the converter. The amount of coke consumed per ton of lead produced was calculated to be approxiamtely 60 kg.

EXAMPLE 4

36.3 tons of a lead concentrate comprising mainly lead carbonate mineral and having the following main analysis: 58.1% Pb, 8.3% Zn, 3.5% S (of which 2.0% was sulphide sulphur), 1.2% Fe, 2.0% $SiO_2+Al_2O_3$and 4.30% C (present as carbonate) were charged batchwise in six batches at roughly 20 minute intervals, together with 4.3 tons of flux, 7 tons of lead-containing sulphatic slime and 3.3 tons of granulated fayalite slag, together with 0.8 tons of coke to the same Kaldo converter as that recited in previous examples. The charge was preheated and smelted with the aid of oil-oxygen gas burners. The time taken to heat and smelt the charge was 330 minutes, and 2800 liters of oil were consumed. Upon completion of the smelting process, 16 tons of molten lead containing 0.1% sulphur could be removed, together with a slag containing 1.8% lead. The amount of coke consumed was calculated to be roughly 50 kg per ton of lead produced, which is a substantial decrease in comsumption when compared with normal coke consumption when smelting lead from oxidic or oxidic-sulphatic starting materials (~150–250 kg/t Pb).

We claim:

1. A method for producing metallic lead from lead-containing starting materials comprising:

(a) smelting the lead-containing starting material under oxidizing conditions to form a lead-containing oxidic melt;

(b) reducing the oxidic melt to extract metallic lead therefrom with a solid carbonaceous reduction agent and in the presence of a solid carbonate-containing material; and (c) recovering molten lead wherein at least one of the amount of reduction agent and the length of the reducing period is less than in the absence of the carbonate-containing material.

2. The method of claim 1 wherein the reduction agent is coal or coke.

3. The method of claim 1 wherein at least a part of the carbonate-containing material comprises at least one of limestone, dolomite and soda ash.

4. The method of claim 2 wherein at least a part of the carbonate-containing material comprises at least one of limestone, dolomite and soda ash.

5. The method of claim 1 wherein at least a part of the lead-containing starting materials comprising carbonate-containing material.

6. The method of claim 2 wherein at least a part of the lead-containing starting materials comprises carbonate-containing materials.

7. The method of claim 1 wherein the reduction agent and the carbonate-containing material are introduced directly to the molten bath during the oxidizing smelting step, after the oxidizing smelting step or both.

8. The method of claim 2 wherein the reduction agent and the carbonate-containing material are introduced directly to the molten bath during the oxidizing smelting step, after the oxidizing smelting step or both.

9. The method of claim 3 wherein the reduction agent and the carbonate-containing material are introduced directly to the molten bath during the oxidizing smelting step, after the oxidizing smelting step or both.

10. The method of claim 5 wherein the reduction agent and the carbonate-containing material are introduced directly to the molten bath during the oxidizing smelting step, after the oxidizing smelting step or both.

11. The method of claim 7 wherein the reduction agent and the carbonate-containing material are injected into the molten bath through at least one of lances, tuyeres or nozzles.

12. The method of claim 8 wherein the reduction agent and the carbonate-containing material are injected into the molten bath through at least one of lances, tuyeres or nozzles.

13. The method of claim 9 wherein the reduction agent and the carbonate-containing material are injected into the molten bath through at least one of lances, tuyeres or nozzles.

14. The method of claim 10 wherein the reduction agent and the carbonate-containing material are injected into the molten bath through at least one of lances, tuyeres or nozzles.

15. The method of claim 1 wherein the carbonate-containing material is mixed with the reduction agent externally of the molten bath.

16. The method of claim 2 wherein the carbonate-containing material is mixed with the reduction agent externally of the molten bath.

17. The method of claim 3 wherein the carbonate-containing material is mixed with the reduction agent externally of the molten bath.

18. The method of claim 5 wherein the carbonate-containing material is mixed with the reduction agent externally of the molten bath.

19. The method of claim 7 wherein the carbonate-containing material is mixed with the reduction agent externally of the molten bath.

20. The method of claim 15 wherein said carbonate-containing material and said reduction agent are mixed in conjunction with the crushing or grinding of said reduction agent.

21. The method of claim 16 wherein said carbonate-containing material and said reduction agent are mixed in conjucntion with the crushing or grinding of said reduction agent.

22. The method of claim 17 wherein said carbonate-containing material and said reduction agent are mixed in conjunction with the crushing or grinding of said reduction agent.

23. The method of claim 18 wherein said carbonate-containing material and said reduction agent are mixed in conjunction with the crushing or grinding of said reduction agent.

24. The method of claim 19 wherein said carbonate-containing material and said reduction agent are mixed in conjunction with the crushing or grinding of said reduction agent.

* * * * *